US010297939B2

(12) United States Patent
Hofmann et al.

(10) Patent No.: US 10,297,939 B2
(45) Date of Patent: May 21, 2019

(54) ELECTRICAL CONTACT HAVING A PIN WHICH IS ARRANGED SUCH THAT IT CAN MOVE

(71) Applicant: Siemens Aktiengesellschaft, Munich (DE)

(72) Inventors: Michael Hofmann, Rieden (DE); Michael Reif, Hirschau (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 214 days.

(21) Appl. No.: 14/513,603

(22) Filed: Oct. 14, 2014

(65) Prior Publication Data

US 2015/0118916 A1 Apr. 30, 2015

(30) Foreign Application Priority Data

Oct. 30, 2013 (DE) ..... 10 2013 222 084

(51) Int. Cl.
*H01R 13/18* (2006.01)
*H01R 13/05* (2006.01)
*H01R 13/24* (2006.01)

(52) U.S. Cl.
CPC ..... *H01R 13/052* (2013.01); *H01R 13/18* (2013.01); *H01R 13/2421* (2013.01); *Y10T 29/49217* (2015.01)

(58) Field of Classification Search
CPC ..... H01R 13/18; H01R 13/17; H01R 13/15; H01R 13/2421
USPC ..... 439/700, 188, 263, 265, 268
See application file for complete search history.

(56) References Cited

U.S. PATENT DOCUMENTS 4,655,526 A * 4/1987 Shaffer ..... H01R 13/193 439/159
6,257,911 B1 * 7/2001 Shelby ..... H01R 13/2421 439/268

FOREIGN PATENT DOCUMENTS

| | | | |
|---|---|---|---|
| CH | 324323 | A | 9/1957 |
| CN | 103000392 | A | 3/2013 |
| CN | 203070997 | U | 7/2013 |
| DE | 643304 | C | 4/1937 |
| DE | 1690120 | U | 12/1954 |
| DE | 1015518 | B | 9/1957 |
| DE | 1540588 | A1 | 1/1970 |
| DE | 2644088 | A1 | 8/1977 |
| DE | 102011082744 | A1 | 3/2013 |
| JP | 2000182717 | A | 6/2000 |

OTHER PUBLICATIONS

Office Action for corresponding Chinese Application No. 201410595314.0 dated Apr. 3, 2018.

* cited by examiner

*Primary Examiner* — Felix O Figueroa
(74) *Attorney, Agent, or Firm* — Harness, Dickey & Pierce, PLC

(57) ABSTRACT

An electrical contact includes a plurality of electrically conductive contact laminations which form a sleeve-like receptacle for a contact bolt. The contact laminations are pressed by a spring force in the direction of a center axis of the sleeve-like receptacle. In a first position of the pin, the pin supports the contact laminations against the spring force; in a second position of the pin, support of the contact laminations by the pin is suppressed.

31 Claims, 3 Drawing Sheets

ELECTRICAL CONTACT HAVING A PIN WHICH IS ARRANGED SUCH THAT IT CAN MOVE

PRIORITY STATEMENT

The present application hereby claims priority under 35 U.S.C. § 119 to German patent application number DE 102013222084.7 filed Oct. 30, 2013, the entire contents of which are hereby incorporated herein by reference.

FIELD

At least one embodiment of the invention generally relates to an electrical contact. In at least one embodiment, the electrical contact has a plurality of electrically conductive contact laminations which form a sleeve-like receptacle for a contact bolt. The contact laminations are pressed by a spring force in the direction of a center axis of the receptacle. This spring force is exerted onto the contact laminations by at least one spring. In other words, the contact laminations are pressed in the direction of a center axis of the receptacle by at least one spring.

BACKGROUND

A contact, which is known per se, is illustrated in FIG. 1. Particularly in the case of contacts with a high current-carrying capacity, the spring or the springs exert considerable spring forces onto the contact laminations since, firstly, low transfer resistances are intended to be realized between the contact laminations and the contact bolt and, secondly, the springs may have to resist large magnetic forces in the event of a short-circuit. Owing to these high spring forces, the contact bolt can be inserted into the receptacle only with a large expenditure of force because, in this case, the contact bolt has to press the contact laminations radially outward against the spring force.

SUMMARY

At least one embodiment of the invention is directed to an arrangement and/or a method in which the contact bolt is insertable into the receptacle with a comparatively low expenditure of force.

According to at least one embodiment of the invention, an arrangement and/or a method are disclosed. Advantageous refinements of the arrangement and of the method are specified in the dependent claims.

At least one embodiment of the invention discloses an arrangement having an electrical contact and a movable pin, wherein the electrical contact has a plurality of electrically conductive contact laminations which form a sleeve-like receptacle for a contact bolt, wherein the contact laminations are pressed by a spring force in the direction of a center axis (longitudinal axis, rotation axis) of the receptacle, and wherein, in a first position of the pin, the pin supports the contact laminations against the spring force, and wherein, in a second position of the pin, support of the contact laminations by the pin is suppressed (that is to say is prevented).

At least one embodiment of the invention further discloses a contact system having an arrangement according to at least one of the above-described embodiments and having a contact bolt, wherein, in the second position of the pin, the contact bolt supports the contact laminations against the spring force. In this contact system, the pin therefore supports the contact laminations against the spring force in the first position of the pin, and the contact bolt supports the contact laminations against the spring force in the second position of the pin. In other words, when the pin moves from the first position to the second position, support of the contact laminations against the spring force is transferred seamlessly: initially, the contact laminations are supported by the pin (in the first position of the pin), and the contact laminations are then supported against the spring force by the contact bolt (in the second position of the pin).

This support is provided without interruption, that is to say the contact laminations are supported against the spring force (either by the pin or by the contact bolt) at any time. As a result, the contact laminations cannot move radially inward in the direction of the center axis at any time. This results in it being possible for the contact bolt to be inserted into the receptacle with a low expenditure of force.

At least one embodiment of the invention further discloses a method for inserting a contact bolt into an electrical contact, wherein the electrical contact has a plurality of electrically conductive contact laminations which form a sleeve-like receptacle for the contact bolt, wherein the contact laminations are pressed by a spring force in the direction of a center axis (longitudinal axis, rotation axis) of the sleeve-like receptacle, and wherein, before the contact bolt is inserted into the receptacle, the contact laminations are supported against the spring force by way of a pin, wherein, in the method, when the contact bolt is inserted into the receptacle, the pin is shifted by the contact bolt in such a way that a distance is created between the pin and the contact laminations, and when the contact bolt is inserted, the contact laminations are supported against the spring force by the contact bolt.

BRIEF DESCRIPTION OF THE DRAWINGS

The invention will be explained in greater detail below with reference to an example embodiment. To this end.

DETAILED DESCRIPTION OF THE EXAMPLE EMBODIMENTS

Figure 1:
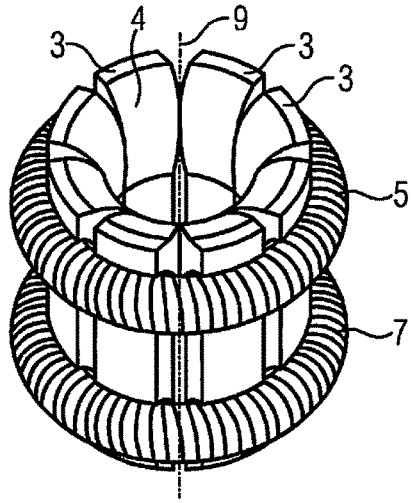
FIG 1 PRIOR ART
FIG. 1 shows an electrical contact, which is known from the prior art, in the form of a tulip contact.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

At least one embodiment of the invention discloses an arrangement having an electrical contact and a movable pin, wherein the electrical contact has a plurality of electrically conductive contact laminations which form a sleeve-like receptacle for a contact bolt, wherein the contact laminations are pressed by a spring force in the direction of a center axis (longitudinal axis, rotation axis) of the receptacle, and wherein, in a first position of the pin, the pin supports the contact laminations against the spring force, and wherein, in a second position of the pin, support of the contact laminations by the pin is suppressed (that is to say is prevented).

In the case of this arrangement, it is particularly advantageous that, in the first position, the pin supports the contact laminations against the spring force. As a result, the contact laminations are not moved or moved only slightly in the direction of the center axis by the spring force in the first position. This results in the contact laminations having to be pressed away only slightly radially outward (against the spring force) when the contact bolt is inserted into the sleeve-like receptacle of the contact bolt, so that the contact bolt can be inserted or plugged into the receptacle with a comparatively low expenditure of force.

As a result, the electrical connection between the electrical contact and the contact bolt can be realized in a simple and convenient manner. Furthermore, it is advantageous for a second position of the pin to be provided, in which position support of the contact laminations by the pin is suppressed or prevented. This second position of the pin can advantageously be present when the contact bolt is inserted into the receptacle. In this second position, the pin therefore does not absorb the spring force, so that the spring force leads to the creation of a slight transfer resistance between the contact laminations and the inserted contact bolt.

The arrangement can be designed in such a way that the spring force is exerted onto the contact laminations by at least one spring. The contacts (tulip contacts) often have two springs which press the contact laminations radially in the direction of the center axis.

The arrangement can also be designed such that, in the second position of the pin, the pin is shifted in the direction of the interior of the sleeve-like receptacle (in contrast to the first position). As a result, there is a clearance/space for the contact bolt.

The arrangement can also be designed in such a way that, in the first position of the pin, the sleeve-like receptacle is widened (in comparison to a pin-free receptacle) as a result of supporting the contact laminations by means of the pin. As a result of supporting the contact laminations, the sleeve-like receptacle is widened in comparison to a pin-free receptacle (that is to say in comparison to a receptacle without a pin). As already described above, this makes it easier to plug the contact bolt into the receptacle.

The arrangement can also be designed in such a way that the pin is arranged at a distance from the contact laminations in the second position. As a result, support of the contact laminations by the pin is advantageously prevented or suppressed in the second position of the pin.

The arrangement can also be constructed such that the pin is connected to a further spring, the spring force of said spring pressing the pin in the direction of the first position. In other words, the spring force of the further spring assists movement of the pin from the second position to the first position. This advantageously results in the pin, when the contact bolt is inserted into the receptacle, being pressed against said contact bolt by the further spring, so that, when the pin is located between the second position and the first position, the pin always bears against the contact bolt. Furthermore, this further spring makes it easier to pull the contact bolt out of the receptacle because the further spring presses the pin, and the contact bolt which bears against the pin, in the direction of the first position, that is to say the further spring presses the pin out of the receptacle.

The arrangement can be designed in such a way that the pin is composed of an electrically insulating material, in particular of a plastic. This prevents the pin from unintentionally transmitting the electrical potential of the contact to the outside/to outside the contact.

The arrangement can also be designed in such a way that the pin is arranged such that it can be shifted along the center axis of the receptacle. This advantageously results in the pin being shifted along the center axis of the receptacle when the contact bolt is inserted into the receptacle along this center axis.

The arrangement can also be designed in such a way that the pin is of rotationally symmetrical design. As a result, the pin is advantageously matched to the shape of contact bolts which are often likewise of rotationally symmetrical design.

The arrangement can also be designed in such a way that the pin is provided with a rod which protrudes from the end of the pin. This rod can advantageously be used as an additional guide for the pin, wherein this guide allows the pin to be shifted, for example, along the center axis of the receptacle.

In this case, the rod can be oriented along the center axis (longitudinal axis, rotation axis) of the pin. In this case, the rod can run outside the pin, advantageously in the interior of the further spring, wherein the further spring is designed as a compression spring, in particular as a helical spring.

The arrangement can also be designed such that the pin has a first region with a first diameter, the pin has a second region with a second diameter, and the second diameter is smaller than the first diameter.

The arrangement can be realized such that, in the first position of the pin, the first region touches the contact laminations. In other words, the pin therefore touches the contact laminations in the region of the first diameter.

The arrangement can also be designed such that, in the first position of the pin, the first region supports the contact laminations. The pin therefore advantageously supports the contact laminations in the region of the first diameter.

The arrangement can also be designed such that, in the second position of the pin, the first region is arranged at a distance from the contact laminations.

The arrangement can also be designed such that the pin has a circumferential collar adjacent to the first region. This circumferential collar advantageously ensures that the pin cannot be shifted beyond the first position starting from the second position (for example by the further spring). In other words, this ensures that the pin cannot be shifted out of the receptacle. This prevents the pin from being lost (that is to say protects against the pin being lost).

At least one embodiment of the invention further discloses a contact system having an arrangement according to the above-described embodiments and having a contact bolt, wherein, in the second position of the pin, the contact bolt supports the contact laminations against the spring force.

In this contact system, the pin therefore supports the contact laminations against the spring force in the first position of the pin, and the contact bolt supports the contact laminations against the spring force in the second position of the pin. In other words, when the pin moves from the first position to the second position, support of the contact laminations against the spring force is transferred seamlessly: initially, the contact laminations are supported by the pin (in the first position of the pin), and the contact laminations are then supported against the spring force by the contact bolt (in the second position of the pin). This support is provided without interruption, that is to say the contact laminations are supported against the spring force (either by the pin or by the contact bolt) at any time. As a result, the contact laminations cannot move radially inward in the direction of the center axis at any time. This results in it being possible for the contact bolt to be inserted into the receptacle with a low expenditure of force.

The contact system can be designed such that the contact bolt has a hollow-cylindrical section and that, in the second position of the pin, the second region of the pin is pushed at least partially into the hollow-cylindrical section. This process of the pin being pushed into the contact bolt firstly results in a particularly compact construction of the contact system, and secondly particularly reliably assists in the contact bolt being able to be pulled out of the receptacle by means of the further spring (in particular, tilting of the pin in relation to the contact bolt is prevented).

At least one embodiment of the invention further discloses a method for inserting a contact bolt into an electrical contact, wherein the electrical contact has a plurality of electrically conductive contact laminations which form a sleeve-like receptacle for the contact bolt, wherein the contact laminations are pressed by a spring force in the direction of a center axis (longitudinal axis, rotation axis) of the sleeve-like receptacle, and wherein, before the contact bolt is inserted into the receptacle, the contact laminations are supported against the spring force by way of a pin, wherein, in the method, when the contact bolt is inserted into the receptacle, the pin is shifted by the contact bolt in such a way that a distance is created between the pin and the contact laminations, and when the contact bolt is inserted, the contact laminations are supported against the spring force by the contact bolt.

In this case, it is particularly advantageous that, when the contact bolt is inserted into the receptacle, the pin is shifted by the contact bolt in such a way that a distance is created between the pin and the contact laminations, and in that, when the contact bolt is inserted, the contact laminations are supported against the spring force by the contact bolt. This has the result that, when the contact bolt is inserted, the pin can no longer prevent the electrical contact between the contact bolt and the contact laminations, and that the contact laminations are pressed onto the contact bolt by the spring force (as a result of which the desired low transfer resistances are produced).

The method can also proceed such that the spring force is exerted onto the contact laminations by at least one spring.

The method can also proceed such that the contact bolt has a hollow-cylindrical section, and, when the contact bolt is inserted into the receptacle, a portion of the pin is pushed into the hollow-cylindrical section.

FIG. 1 shows an electrical contact 1 which is known per se from the prior art. This contact 1 has eight contact laminations 3 (laminated contacts 3) which form a sleeve-like receptacle 4 for a contact bolt (not illustrated). The electrical contact further has a first spring 5 and a second spring 7, said springs each being designed as an annular helical spring. The first spring 5 and the second spring 7 exert a spring force onto the contact laminations 3, wherein said spring force presses the contact laminations 3 in the direction of a center axis 9 of the receptacle 4. The receptacle 4 which is formed by the eight contact laminations 3 is rotationally symmetrical in sections, so that the center axis 9 constitutes a rotation axis 9 of the receptacle. The center axis 9 could also be called a longitudinal axis 9 of the receptacle 4 or a longitudinal axis 9 of the contact 1. The contact 1 is of substantially circular construction, that is to say it has a substantially circular cross-sectional area.

An electrical contact 1 of this kind is occasionally also called a tulip contact because the contact laminations are arranged in a similar manner to the petals of a tulip. FIG. 1 shows, by way of example, an electrical contact of this kind with eight contact laminations 3. However, contacts of this kind can also have a different number of contact laminations, for example four contact laminations or six contact laminations.

A contact bolt (that is to say a bolt-like contact, for example a contact with a circular-cylindrical casing surface) can be pushed into the interior of the contact laminations 3 along the center axis 9 (that is to say into the sleeve-like receptacle 4 which is formed by the contact laminations 3). In this case, the contact bolt (which is usually of rotationally symmetrical design and has a center axis/rotation axis) is pushed coaxially into the receptacle 4. In this case, the center axis 9 of the receptacle 4 and the center axis of the contact bolt coincide, that is to say the center axes of the receptacle 4 and the contact bolt coincide.

In the case of the contact 1 which is known from the prior art, the contact bolt, when it is pushed in, presses the contact laminations 3 outward against the spring force of the first spring 5 and of the second spring 7. As a result, a considerable force has to be applied in order to push the contact bolt into the contact. A considerable expenditure of force is also required to pull the contact bolt out of a contact 1 of this kind since a considerable frictional force between the inside of the contact laminations and the contact bolt is produced by the force of the springs 5 and 7. Therefore, overall, a considerable expenditure of force is necessary in order to push a contact bolt into a contact 1 of this kind or to pull a contact bolt out of a contact 1 of this kind. (If the spring force of the springs 5 and 7 were designed to be weaker, the current-carrying capacity of the contact would drop. Therefore, the problem of the high expenditure of force cannot be satisfactorily solved in this way.)

Figure 2:
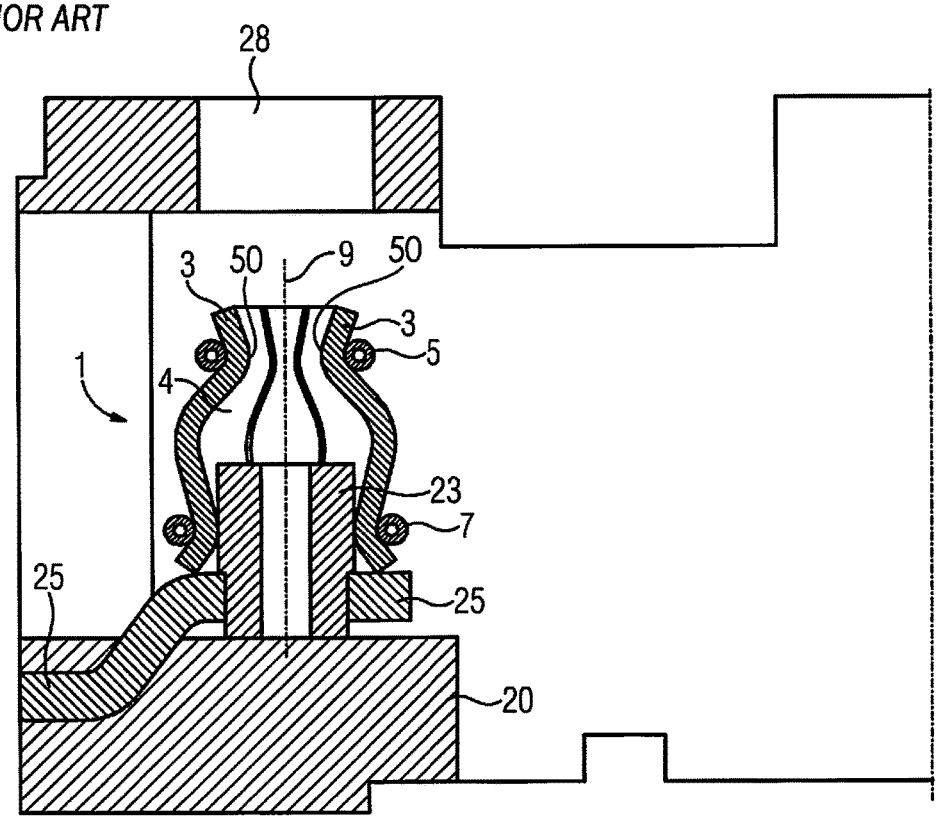
FIG 2 PRIOR ART
FIG. 2 shows the contact, which is arranged in a housing, without the pin and without the contact bolt.

FIG. 2 shows a sectional illustration through a housing 20 having the electrical contact 1. The contact 1 is in this case part of a plug-in base, and therefore the housing 20 can also be called a plug-in base housing 20. A contact bolt is not inserted into the contact 1, and the contact 1 does not have a pin. Therefore, the spring force of the first spring 5 deforms one end (upper) region of the contact laminations 3 in such a way that the ends of the contact laminations are moved in the direction of the center axis 9. In other words, the end of the sleeve-like receptacle 4 is constricted by the first spring 5, so that the inside diameter of the sleeve-like receptacle is considerably reduced by the first spring 5. (This constriction is illustrated in an overemphasized manner in FIG. 2 for better clarity.) The opposite end of the contact 1 is fastened to a mating bearing 23 by means of the second spring 7, that is to say the second spring 7 presses the contact laminations 3 onto the mating bearing 23.

As a result, electrical contact is established between the contact laminations 3 and the mating bearing 23. The mating bearing is substantially in the form of a hollow cylinder. The outside diameter of the hollow cylinder corresponds to the outside diameter of the contact bolt (not illustrated). The mating bearing 23 is electrically conductively connected, for example soldered, to a busbar 25. Electric current is conducted to the contact 1 by means of said busbar 25. The contact laminations 3, the mating bearing 23 and the busbar 25 are composed of an electrically conductive metal, for example of copper. In contrast, the housing 20 is composed of an insulating material, for example of plastic. The housing 20 has an opening 28 through which a contact bolt can be inserted (from above) into the housing and into the sleeve-like receptacle. It can clearly be seen that the contact bolt, when inserted into the receptacle 4 which is formed by the contact laminations 3, has to press back the contact laminations 3 radially outward against the spring force in the region of the first spring 5. As a result, a considerable expenditure of force is necessary in order to push the contact bolt into the contact 1.

Figure 3:
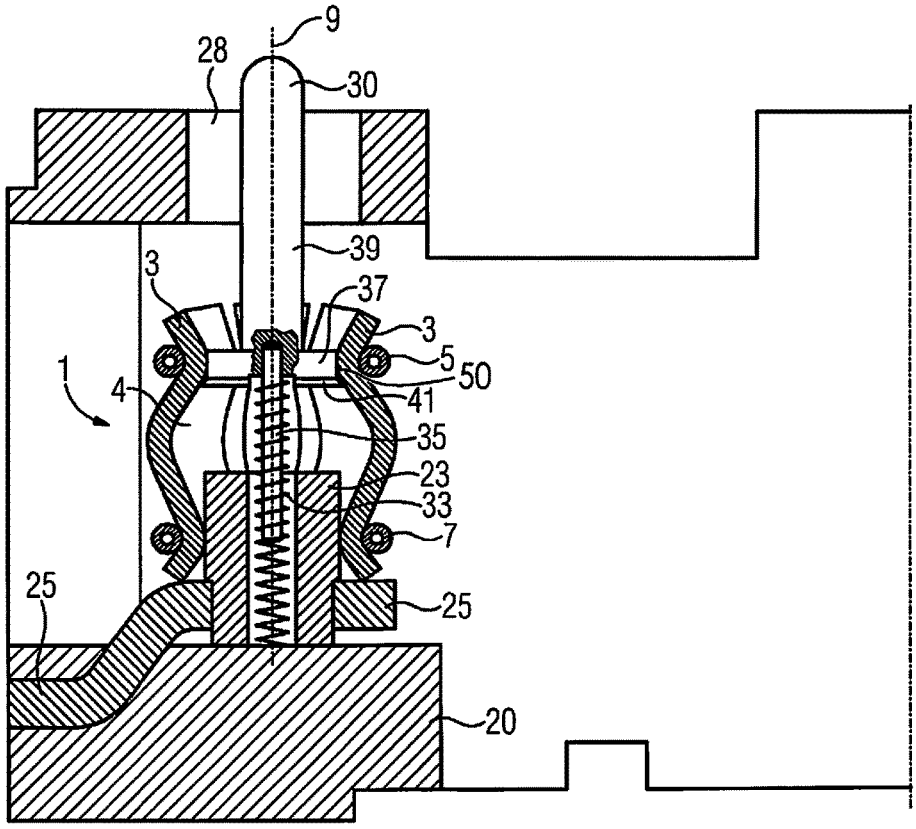
FIG. 3 shows the contact with a pin which is located in the first position.

FIG. 3 shows that a pin 30 and a further spring 33 are added to the arrangement according to FIG. 2. The further spring 33 is designed as a compression spring, in particular as a helical spring. In this case, the pin additionally has a rod 35 which protrudes out of the end of the pin 30. The rod 35 is oriented along the center axis 9 of the pin (which corresponds to the center axis 9 of the contact 1). The rod 35 is arranged outside the pin 30 in the interior of the further spring 33.

The pin 30 is arranged such that it can be shifted along the center axis 9 of the receptacle 4. In the exemplary embodiment, the pin 30 is of rotationally symmetrical design. The pin 30 has a first region 37. This first region 37 has a first diameter. A second region 39 of the pin is arranged adjacent to the first region 37, said second region having a second diameter. In this case, the second diameter is smaller than the first diameter. The first region 37 and the second region 39 are each in the form of a circular cylinder. A circumferential collar 41 is arranged on the pin 30 at the free end of the first region 37. In the exemplary embodiment, the circumferential collar 41 has a triangular cross-sectional area. However, the collar can also have a different cross-sectional area, for example a rectangular or semicircular cross-sectional area. The collar can also be called a circumferential web.

The first position of the pin 30 is illustrated in FIG. 3. In this first position of the pin 30, the pin 30 supports the contact laminations 3 against the spring force of the first spring 5. More precisely, in the first position of the pin, the first region 37 touches the contact laminations 3 or the first region 37 supports the contact laminations against the spring force of the spring 5. As a result, the contact laminations 3 are expanded at one end (in comparison to the contact without the pin, as is illustrated in FIG. 2), so that the sleeve-like receptacle 4 which is formed by the contact laminations is likewise widened or expanded for the contact bolt. In comparison to FIG. 2, it can clearly be seen that, in FIG. 3, the receptacle of the contact 1 has a substantially larger inside diameter than in FIG. 2 owing to the supporting effect of the pin 30. As a result, a contact bolt which is intended to be inserted into the contact 1 along the center axis 9 from above can be inserted into the contact with a substantially lower expenditure of force.

Furthermore, FIG. 3 clearly shows that the collar 41 prevents the further spring 33 from pushing the pin 30 (upward) beyond the illustrated first position of the pin. This ensures that the sleeve-like receptacle is always supported or widened by the pin when the contact bolt is not inserted. The pin 30 cannot be lost either.

The pin 30 is composed of an electrically insulating material, in particular of a plastic. This plastic may be, for example, polyoxymethylene (POM). The electrically insulating material prevents the electrical potential of the contact 1 from being conducted out of the housing 20 via the pin 30. Furthermore, the electrically insulating material of the pin prevents a person from accidentally touching the contact 1 through the opening 28 in the plug-in base housing 20 (protection against accidents due to electric shock).

The pin 30 is illustrated in a broken-open manner in its lower part, so that it is possible to see how the rod 35 is secured in the pin 30: in the exemplary embodiment, the rod 35 is composed of metal and is pressed into the pin 30. The rod 35 serves, in cooperation with the further spring 33, as an additional guide for the pin 30 when the pin 30 is shifted along the center axis 9. This shifting is illustrated in the following figure.

Figure 4:
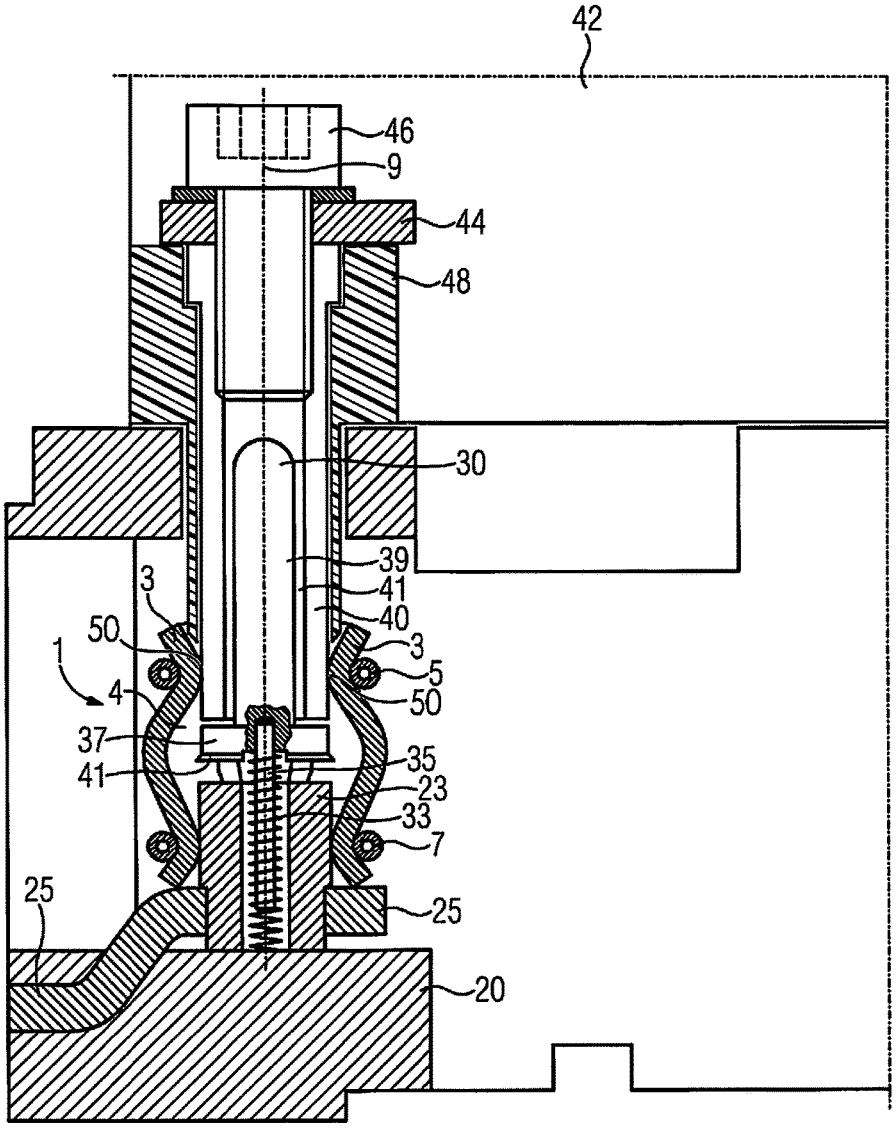
FIG. 4 shows the contact with the contact bolt inserted and with the pin located in the second position.

FIG. 4 shows the contact 1 with an inserted contact bolt 40 (bolt contact 40). The contact bolt 40 has been pushed (from above) into the housing 20 and into the contact 1 through the opening 28. In the process, the contact bolt 40 has shifted the pin 30 (downward) along the center axis 9, so that the pin 30 is now located in a second position. The contact bolt 40 connects with the laminations 3 at lamination contact surfaces 50. In this second position of the pin, the pin 30 is shifted in the direction of the interior of the sleeve-like receptacle 4 (in comparison to the first position).

The contact bolt 40 has a hollow-cylindrical section 41. In the illustrated second position of the pin 30, the second region 39 of the pin is pushed into said hollow-cylindrical section 41. As a result, the free end of the contact bolt 40 is in contact with an end face of the first region 37 of the pin. As a result, the pin 30 has been shifted into the second position.

It can clearly be seen that the pin 30 is arranged at a distance from the contact laminations 3 in the second position. In particular, the first region 37 of the pin 30 is arranged at a distance from the contact laminations 3. As a result, in the second position of the pin 30, support of the contact laminations 3 by the pin 30 is suppressed or prevented, that is to say the contact laminations 3 are not supported by the pin 30. Instead, in the second position, the contact laminations 3 are supported against the spring force of the spring 5 by the contact bolt 40. In other words, the spring 5 presses the contact laminations 3 onto the contact bolt 40 by way of its spring force, so that a good electrical connection is achieved between the contact bolt 40 and the contact laminations 3 (low electrical transfer resistance). Therefore, in the illustrated second position, the pin 30 does not impede the formation of electrical contact between the contact bolt 40 and the contact laminations 3. The contact bolt 40 therefore forms the mating contact piece for the contact 1.

In other words, when the contact bolt is inserted/pushed into the receptacle 4, the pin 30 is shifted by the contact bolt 40 such that a distance is created between the pin 30 and the contact laminations 3. When the contact bolt is inserted, the contact laminations are then supported against the spring force of the first spring 5 by the contact bolt 40. This results in an advantageous method for inserting the contact bolt 40 into the electrical contact 1.

Furthermore, FIG. 4 clearly shows that the outside diameter of the first region 37 of the pin 30 corresponds to the outside diameter of the contact bolt 40. For this reason, when the contact bolt is pushed in, the contact laminations 3 readily slide from the first region 37 of the pin 30 onto the contact bolt 40, without the contact laminations 3 having to be further expanded for this purpose. Therefore, the contact bolt 40 can be pushed (from above) into the contact 1 along the center axis 9 very easily and with a low expenditure of force.

FIG. 4 also clearly shows that, when the contact bolt is pulled out of the contact 1 (upward) along the center axis 9, the pin 30 is pressed in the direction of its first position (as illustrated in FIG. 3) by the further spring 33. In other words, when the contact bolt 40 is pulled out of the contact 1, the first region 37 of the pin 30 always bears against the end of the contact bolt 40. As a result, the contact laminations 3 slide directly over the casing surface of the contact bolt 40 onto the first region 37 of the pin 30 and as a result remain in their widened position (that is to say the large inside diameter of the contact 1, which large inside diameter is illustrated in FIG. 4, also remains when the contact bolt 40 is pulled out). This also allows the contact bolt to be pulled out of the contact 1 in a simple manner, without a large expenditure of force being required for this purpose. The further spring 33 additionally assists, by way of its spring force, the process of pulling the contact bolt out of the contact 1, because said spring indirectly exerts a pressure force onto the contact bolt 40 by means of the pin 30. In other words, the further spring 33 assists a movement of the pin from the second position to the first position.

The pin 30 is a spring-action intermediate piece which, in its first position, is arranged between the contact 1 and the contact bolt 40. Owing to the pin 30, the contact laminations 3 also remain secured in their expanded position after the contact bolt 40 is pulled out. As a result, only a highly minimized force is required in order to plug the contact bolt into the contact or in order to pull said contact bolt out of the contact again.

In the example embodiment, the contact bolt 40 is part of a circuit breaker 42 which may be, in particular, a compact circuit breaker (MCCB=Molded Case Circuit Breaker). Only a busbar 44 of the circuit breaker 42, which busbar is electrically conductively connected to the contact bolt 40 by means of a screw 46, is shown. (The contact bolt 40 and the screw 46 are likewise illustrated in section; however, for reasons of better clarity, they have not been illustrated in a hatched manner.) Furthermore, FIG. 4 shows that the contact bolt 40 is electrically insulated from being touched by means of a plastic insulation 48. Therefore, in the illustrated exemplary embodiment, the circuit breaker 42 is electrically connected to the contact 1 of the plug-in base housing 20 by means of the contact bolt 40. By means of a contact 1 (plug-in base contact 1) of this kind, circuit breakers can be removed from an electrical circuit and/or replaced by a new circuit breaker in a quick, simple and reliable manner as required. Plug-in bases with contacts 1 of this kind are accessories of compact circuit breakers and, on account of the high spring force of the first spring 5 and of the second spring 7, ensure reliable current transmission even for large currents, without an undesirably high level of heat developing. This is achieved on account of low transfer resistances. The high spring forces of the first spring 5 and of the second spring 7 also have the advantageous effect that they can counteract high electromagnetic forces which occur in the event of a short-circuit.

Considering that circuit breakers 42 generally have a plurality of contact bolts 40 which are pushed into respectively associated contacts 1 or pulled out of contacts 1 at the same time, it is clear that the advantage of the low requisite plug-in forces or pull-out forces will be multiplied as a result. This provides the option of connecting contact bolts (and therefore, in particular, circuit breakers which are fitted with contact bolts) to the corresponding contacts in a very simple, reliable and convenient manner by means of a plug connection. This constitutes a considerable improvement in handling when fitting or removing circuit breakers of this kind in/from electrical circuits.

The described solution has a series of advantages:

- Only a fraction of force is required in order to plug the contact bolt (or the circuit breaker having one or more contact bolts) into the contact (or the contacts) or in order to pull said contact bolt (or said circuit breaker having one or more contact bolts) out of the contact (or the contacts) again.
- In the plugged-in state, there are no disadvantages in respect of current transmission because all of the spring force of the first spring and of the second spring is furthermore applied to the contact bolt.
- The contact bolts can be produced as simple bolts without special contours, this being possible in a cost-effective manner.

An arrangement and a method in which the contact bolt can be inserted into the contact or pulled out of the contact with a comparatively lower expenditure of force have been described.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a tangible computer readable medium and is adapted to perform any one of the aforementioned methods when run on a computer device (a device including a processor). Thus, the tangible storage medium or tangible computer readable medium, is adapted to store information and is adapted to interact with a data processing facility or computer device to execute the program of any of the above mentioned embodiments and/or to perform the method of any of the above mentioned embodiments.

The tangible computer readable medium or tangible storage medium may be a built-in medium installed inside a computer device main body or a removable tangible medium arranged so that it can be separated from the computer device main body. Examples of the built-in tangible medium include, but are not limited to, rewriteable non-volatile memories, such as ROMs and flash memories, and hard disks. Examples of the removable tangible medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An arrangement comprising:

an electrical contact;

a mating bearing having a width, the electrical contact attached to the mating bearing, and a pin, arranged to be movable, the electrical contact including a plurality of electrically conductive contact laminations which have contact surfaces and form a sleeve-like receptacle for a contact bolt, the contact surfaces protruding toward a center of the formed sleeve-like receptacle, wherein the contact laminations are pressed by a spring force in a direction toward a center axis of the sleeve-like receptacle, wherein, in a first position of the pin, the pin contacts an apex of the contact surfaces and supports the contact laminations at a diameter that is about equal to the width of the mating bearing against the spring force, and wherein, in a second position of the pin, the contact surfaces of the contact laminations remain about at the diameter via contact between the contact bolt and the apex of the contact surfaces.

2. The arrangement of claim 1, wherein, in the second position of the pin, the pin is shiftable in a direction towards an interior of the sleeve-like receptacle.

3. The arrangement of claim 1, wherein, in the first position, the sleeve-like receptacle is configured to be widened as a result of supporting the contact laminations.

4. The arrangement of claim 1, wherein, the pin is arranged at a distance from the contact laminations in the second position.

5. The arrangement of claim 1, wherein the pin is connected to a further spring, the spring force of said further spring pressing the pin in a direction towards the first position.

6. The arrangement of claim 1, wherein the pin is arranged to be shiftable along a center axis of the receptacle.

7. The arrangement of claim 1, wherein the pin is of rotationally symmetrical design.

8. The arrangement of claim 1, wherein the pin is provided with a rod which protrudes from an end of the pin.

9. The arrangement of claim 8, wherein the rod is oriented along a center axis of the pin.

10. The arrangement of claim 1, wherein the pin is composed of an electrically insulating material.

11. The arrangement of claim 10, wherein the electrically insulating material is a plastic.

12. A contact system comprising:

the arrangement of claim 1; and a contact bolt having a bolt contact diameter substantially corresponding to the diameter of the supported contact surfaces of the contact laminations, wherein, in the second position of the pin, the contact bolt is configured to support the contact laminations against the spring force.

13. The contact system of claim 12, wherein the contact bolt has a hollow-cylindrical section and, in the second position of the pin, the second region of the pin is configured to be pushed at least partially into the hollow-cylindrical section.

14. The arrangement of claim 1, wherein the spring force is exerted onto the contact laminations by at least one spring.

15. The arrangement of claim 14, wherein, in the second position of the pin, the pin is shiftable in a direction of an interior of the sleeve-like receptacle.

16. The arrangement of claim 14, wherein, in the first position, the sleeve-like receptacle is configured to be widened as a result of supporting the contact laminations.

17. The arrangement of claim 14, wherein, the pin is arranged at a distance from the contact laminations in the second position.

18. The arrangement of claim 14, wherein the pin is provided with a rod which protrudes from an end of the pin.

19. The arrangement of claim 18, wherein the rod is oriented along a center axis of the pin.

20. The arrangement of claim 1, wherein the pin includes a first region with a first diameter, the pin includes a second region with a second diameter, and the second diameter is smaller than the first diameter.

21. The arrangement of claim 20, wherein, in the first position of the pin, the first region supports the contact laminations.

22. The arrangement of claim 20, wherein, in the second position of the pin, the first region is arranged at a distance from the contact laminations.

23. The arrangement of claim 20, wherein the pin includes a circumferential collar adjacent to the first region.

24. The arrangement of claim 20, wherein, in the first position of the pin, the first region touches the contact laminations.

25. The arrangement of claim 24, wherein, in the first position of the pin, the first region supports the contact laminations.

26. The arrangement of claim 24, wherein, in the second position of the pin, the first region is arranged at a distance from the contact laminations.

27. The arrangement of claim 24, wherein the pin includes a circumferential collar adjacent to the first region.

28. A method for inserting a contact bolt into an electrical contact, the electrical contact attached to a mating bearing having a width and including a plurality of electrically conductive contact laminations which have contact surfaces and form a sleeve-like receptacle for the contact bolt, the contact laminations being pressed by a spring force in a direction towards a center axis of the sleeve-like receptacle, and, before the contact bolt is inserted into the receptacle, the contact laminations are supported at an apex of the contact surfaces against the spring force at the width of the mating bearing by contact between the apex of the contact surfaces and a pin, the method comprising:

shifting the pin, when the contact bolt is inserted into the receptacle, by the contact bolt to create a distance between the pin and the contact laminations; and supporting, when the contact bolt is inserted, the contact laminations against the spring force via contact between the apex of the contact surfaces of the contact laminations and the contact bolt.

29. The method of claim 28, wherein the contact bolt includes a hollow-cylindrical section, and, when the contact bolt is inserted into the receptacle, a portion of the pin is pushed into the hollow-cylindrical section.

30. The method of claim 28, wherein the spring force is exerted on the contact laminations by at least one spring.

31. The method of claim 30, wherein the contact bolt includes a hollow-cylindrical section, and, when the contact bolt is inserted into the receptacle, a portion of the pin is pushed into the hollow-cylindrical section.

* * * * *